US006217735B1

(12) United States Patent
Reynolds

(10) Patent No.: US 6,217,735 B1
(45) Date of Patent: Apr. 17, 2001

(54) ELECTROPLATING BATH WITH MEGASONIC TRANSDUCER

(75) Inventor: H. Vincent Reynolds, Marcellus, NY (US)

(73) Assignee: Reynolds Tech Babricators, Inc., East Syracuse, NY (US)

( * ) Notice: Subject to any disclaimer, the term of this patent is extended or adjusted under 35 U.S.C. 154(b) by 0 days.

(21) Appl. No.: 09/314,400

(22) Filed: May 19, 1999

(51) Int. Cl.[7] ..... C25D 5/00; C25D 11/32
(52) U.S. Cl. ..... 205/137; 205/157; 205/91
(58) Field of Search ..... 205/137, 157, 205/91; 204/222, 273

(56) References Cited

U.S. PATENT DOCUMENTS 3,969,544 7/1976 Obeda ..... 427/57
4,545,884 * 10/1985 Francis ..... 204/202
4,750,977 6/1988 Marrese ..... 204/27
5,865,894 2/1999 Reynolds ..... 118/429

FOREIGN PATENT DOCUMENTS 53-28039 * 3/1978 (JP) .

* cited by examiner

*Primary Examiner*—Edna Wong
(74) *Attorney, Agent, or Firm*—Bernhard P. Molldrem, Jr.

(57) ABSTRACT

A megasonic plating technique employs a megasonic transducer to create a ridge of electrolyte that extends upward above a plating tray. A chuck holds the substrate to be plated so the face of the wafer is oriented downwards. The megasonic transducer extends along a base of the center part of the tray, and an elongated anode element is positioned above the transducer. Spargers introduce electrolyte into the tray non-turbulently along opposite sides of the transducer. There is a transverse relative motion created between the tray and the chuck so that the ridge of electrolyte sweeps across the face of the substrate.

6 Claims, 3 Drawing Sheets

ELECTROPLATING BATH WITH MEGASONIC TRANSDUCER

BACKGROUND OF THE INVENTION

This invention relates to wet process chemistry treatment of substrates, e.g., semiconductor wafers and the like, and is more particularly directed to a technique for plating a flat workpiece in a manner that is efficient and also minimizes surface defects. The invention also concerns a technique that facilitates robotic handling of the articles.

Electroplating plays a significant role in the production of many rather sophisticated technology products, and has recently begun to be used for metallization of semiconductor devices. Recently there has been interest in using plating techniques to form copper conductors on silicon to increase the power or speed of the semiconductor devices.

A number of techniques for electro-depositing or coating on an article face been described in the patent literature.

A recent technique that employs a laminar flow sparger or injection nozzle within the plating bath is described in my recent U.S. Pat. No. 5,597,460, granted Jan. 28, 1997. The means described there achieve an even, laminar flow across the face of the substrate during the plating operation. A backwash technique carries the sludge and particulate impurities away from the article to be plated, and produces a flat plated article of high tolerance, such as a high-density compact disc master or semiconductor wafer. The techniques in that patent improve the flow regime for the plating solution within the tank or cell, as the flow regime is regarded as being crucial for successful operation. Flow regime is affected by such factors as tank design, fluid movement within the process vessel, distribution of fluid within the vessel and at the zone of introduction of the solution into the vessel, and the uniformity of flow of the fluid as it is contacts and flows across the substrate in the plating cell.

In the plating cell as described in said U.S. Pat. No. 5,597,460, a plating bath contains the electrolyte or plating solution, in which the substrate to be plated is submerged in the solution. A sparger or equivalent injection means introduces the solution into the plating bath and forms a laminar flow of the electrolyte or plating solution across the surface of the substrate to be plated. A circulation system draws off the solution from the anode chamber, together with any entrained particles, and to feeds the solution through a microfilter so that all the particles of microscopic size or greater are removed from the plating solution. Then the filtered solution is returned to the sparger and is re-introduced into the plating cell.

The flow regime as described in said U.S. Pat. No. 5,597,460 is further improved by the geometry of the well that forms the tank for the plating bath. The well has a cylindrical wall that is coaxial with the axis of the substrate. This arrangement was intended to avoid corners and dead spaces in the plating cell, where either the rotation of the substrate or the flowing movement of the plating solution might otherwise create turbulences.

An increased evenness in plating is achieved by the technique of my U.S. Pat. No. 5,634,564 in which a rotary blade or wiper is positioned in the plating bath.

Electroless plating is favored in many applications, and especially in those where there is no electrically conductive layer that could serve as a cathode. Accordingly, electroless plating is now seen as an economical alternative to sputtering or vacuum deposition. This is especially true for metals that are difficult to deposit using sputtering or plasma techniques. One advantageous approach to electroless plating is disclosed in my earlier U.S. Pat. No. 5,865,894. In that arrangement, a megasonic transducer adjacent the floor of the plating cell applies megasonic energy at a frequency of about 0.2 to 5 MHz to the solution. The frequency can be above 1 MHz, and in some cases above 5 MHz. The megasonic waves distribute the solution evenly on the substrate, and also break up any bubbles or concentrations that may lead to defects in the plated surface.

Megasonic plating technique can improve the process for electroplating silicon wafers, and an example of this technique, in which the flow regime is further improved by imposing a rotary motion, as described in my U.S. Pat. No. 5,865,894. The megasonic transducer and the rotary blade can be incorporated together in a plating cell, as described and illustrated in my pending U.S. patent application Ser. No. 08/954,239, filed Oct. 20, 1997 now U.S. Pat. No. 5,904,827.

The techniques described in my U.S. Pat. No. 5,932,027 permit mounting the substrate and lowering the substrate into the plating cell to be automated or robotized. Automation and robotization of the insertion, removal, and transport of the workpiece from one process cell to another make it possible to conduct the entire multiplestep plating operation in a clean or super-clean environment. In the technique of that application, the carrier for the substrate is disposed on a sealable door for the plating cell. The door opens to a loading position, which is preferably the horizontal position, and closes to a position which preferably holds the substrate vertically in the plating chamber. The door sealably seats onto an opening in a side wall of the cell. For electroplating use, a cathode ring may be disposed at the periphery of the door opening for making electrical contact with the substrate when the door is closed. This arrangement can lend itself to robotization of the plating process, but nevertheless requires the transfer of the substrate from a transfer holder to a platen associated with the plating cell. Moreover, mechanical and fluid handling considerations must be addressed because of the need to move the substrate between horizontal and vertical orientations.

High precision electroplating in the past has required either rotation of the substrate or rotation of a wiper to induce the removal of hydrogen bubbles from the surface to obtain uniform plating free of defects. For this reason the substrate had to be positioned either in a vertical orientation or in a diagonal or slant orientation, rather than horizontal, so that the bubbles would not collect on the surface. There has not been an effective technique for plating wafers or other substrates in a horizontal, circuit-side-down, orientation.

OBJECTS AND SUMMARY OF THE INVENTION

Accordingly, it is an object of this invention to provide an electroplating arrangement which reliably and evenly plates metallic material onto a wafer or other substrate, and which avoids the drawbacks of the prior art.

It is another object of this invention to provide an electroplating arrangement in which the substrate is maintained in a horizontal position, and which can be adapted easily to an automated wafer handling mechanism.

According to one aspect of the present invention, a planar face of a substrate is plated with a metal layer. The plating is carried out with the substrate held horizontal, and with the planar face, i.e., the circuit side of the wafer of other substrate, oriented downwards. The associated electroplating bath employs an elongated, horizontally extending tray that has an open top. An elongated, horizontally extending megasonic transducer is situated at the base of the tray, and an anode extends horizontally above the transducer. A sparger arrangement supplies a flow of a process fluid, such as an electrolyte, into the tray, and the megasonic transducer creates a transverse ridge of the electrolyte or other wet process fluid that projects upwards from the tray. This ridge can contact a substrate passing over the tray. The method of plating involves applying megasonic energy to the transducer to create the transverse ridge of said electrolyte. A plating current is applied between the anode and the substrate. The substrate is oriented horizontally and face down so it is in position to contact the transverse ridge of electrolyte, and then either the substrate holder or the tray is moved in the direction across the ridge to effect relative motion as between substrate and tray so that the ridge sweeps across the face of the substrate. A rinser may be positioned alongside the electrolyte tray for rinsing the substrate after the plating operation.

The anode may be in the form of a transverse metal rod or similar conductive member that extends parallel to the transducer and above it within said electrolyte. Alternatively, the anode may be incorporated as a lens of the transducer, and may take the form of a stainless steel surface affixed onto a top of the transducer. The holder for the wafer or other substrate may be a heated or unheated chuck. The megasonic energy also heats the substrate where the ridge contacts it, and in some cases may partially or fully heat-treat the metallization.

Preferably, the sparger arrangement creates a non-turbulent flow of the electrolyte that emanates from each side of the megasonic transducer. In a preferred mode, the sparger arrangement includes first and second rows of openings, one row disposed along one side of the transducer, and one row disposed along the other side.

The above and many other objects, features, and advantages of this invention will become more fully appreciated from the ensuing detailed description of a preferred embodiment, which is to be considered in conjunction with the accompanying Drawing.

DETAILED DESCRIPTION OF A PREFERRED EMBODIMENT

Figure 1:
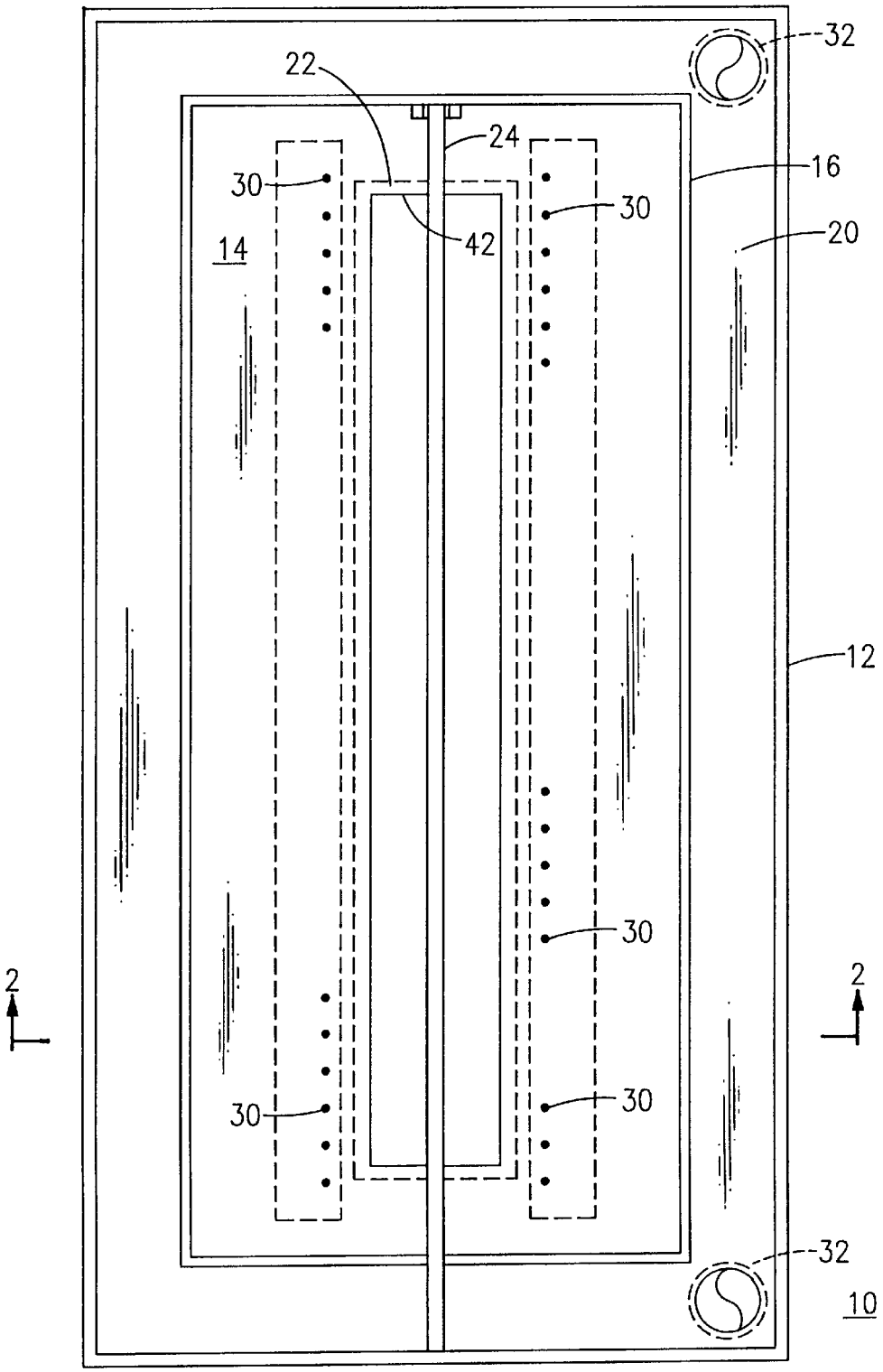
FIG. 1 is a plan of an electroplating bath arrangement according to one preferred embodiment of this invention.
Figure 2:
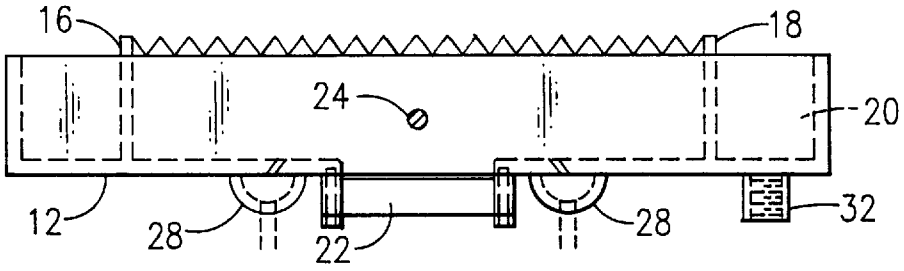
FIG. 2 is a sectional of this embodiment taken at line 2—2 of FIG. 1.
Figure 2A:
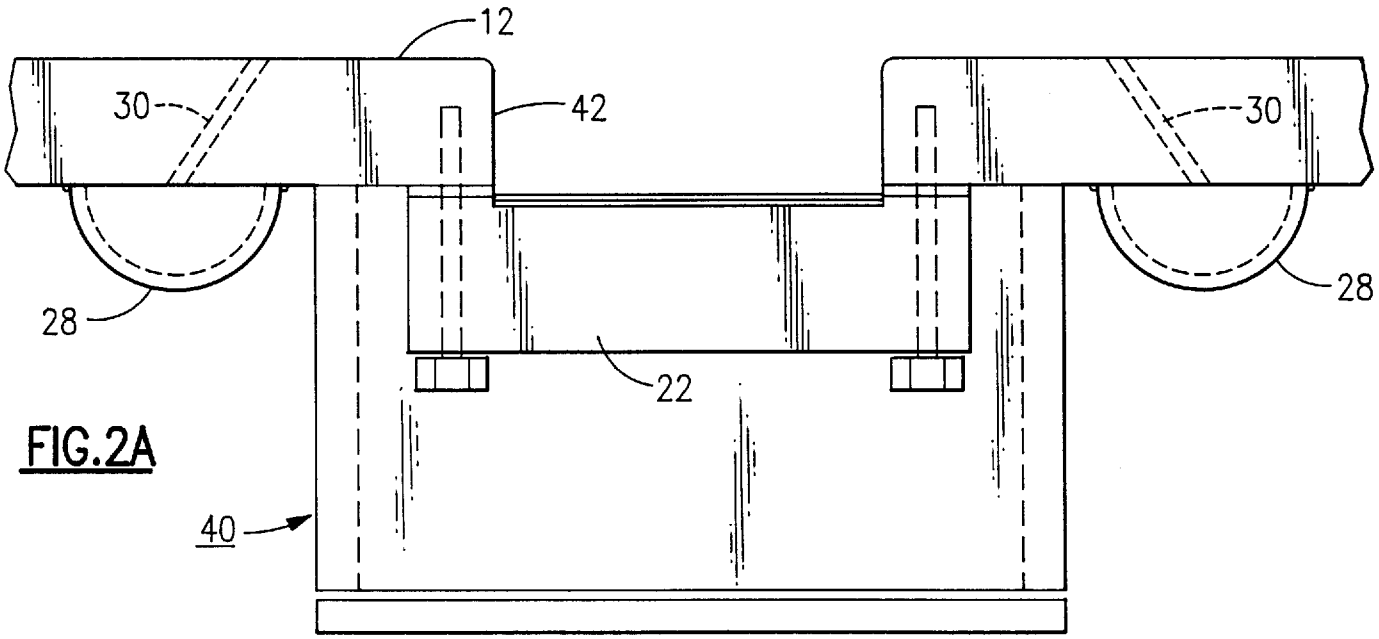
FIG. 2A is an enlargement of a portion of FIG. 2.

A megasonic plating arrangement 10 according to an embodiment of this invention is illustrated in FIGS. 1, 2 and 2A. Although not shown here, the arrangement 10 can be disposed within a cabinet, with a clean air system and automatic wafer handling equipment so that the plating, and possibly other process steps, are carried out automatically for a number of wafers or other workpieces in sequence. The system also includes fluid treatment and replenishment equipment, which is not shown here but would be understood by those skilled in this art. As shown in the plan view of FIG. 1, an elongated tray or basin 12 is preferably formed of a durable non-reactive, non-conductive material such as polypropylene. The tray is elongated in one horizontal direction, and has an open top. The tray has an elongated central portion 14 whose bounds are defined by a generally rectangular weir 16. As shown in FIG. 2, the weir 16 has a sawtooth upper edge 18 that serves as a spillway for fluid exiting the central portion 14. A trough 20 surrounds the weir 16 and receives any liquid that spills over the weir. A megasonic transducer 22 is situated in the base of the tray at the central portion 14, and here is shown elongated in the long direction of the tray. A stainless steel rod 24, which serves as anode, is positioned to extend through one wall of the weir 16 and across the central portion, above and centered over the transducer 22. A pair of spargers 26 are formed on the floor of the tray and are situated one opposite sides of the transducer 22. Each sparger 26 is in the form of a semicylindrical tubular member 28, with a row of openings 30 through the floor of the tray 12 to introduce a fluid flow into the central portion 14 of the tray. The spargers create a laminar, i.e., non-turbulent flow of the electrolyte out over the top of the megasonic transducer 22. The openings 50 can be holes, pores or foramina. Instead of a row of openings 30, the spargers 26 can be provided with a slit or a series of slits. There can be more than one row on a side. Still other configurations are possible within the scope of this invention. Here the holes 30 are shown drilled through at a slant in the direction towards the mid-line of the tray 12 and of the transducer 22. Also shown here is a drain tube 32 for conducting away fluid that enters the trough 20. While not shown here, the drain tube connects with a return conduit to pump, filtration, and fluid conditioning equipment, and the conditioned fluid is eventually supplied again to the spargers 26, 26.

As shown in FIG. 2A, there can be a cover 40 beneath the tray 12 to protect the megasonic transducer. This is removable to service the transducer. As also shown here, the transducer 22 fits against a generally rectangular opening 42 in the floor of the tray, so that the transducer is in direct contact with the fluid. The opening 42 serves as a megasonic lens.

Figure 3:
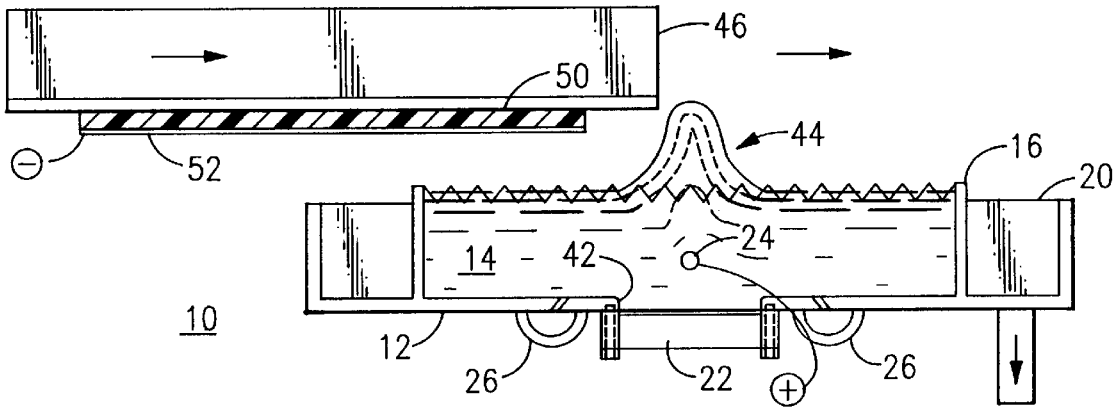
FIG. 3 is a sectional elevation for explaining the operation of this invention.

The plating operation of this invention is illustrated in FIG. 3, in which the parts and elements described earlier are identified with the same reference numbers. In this embodiment, the megasonic transducer 22 directs its energy upwards into the fluid in the tray 12 directly over the opening or lens 42. This pushes the fluid upwards, in effect creating a fluid wall or ridge 44. The frequency is selected within the megasonic range (nominally 500 KHz to 5 MHz) as is the strength of the applied megasonic signal, so as to achieve an optimal ridge 44. This ridge extends for the length of the opening 42, and rises above the top of the weir 16. A chuck or platen 46 is situated for horizontal motion, and is disposed to hold a semiconductor wafer 50, or other substrate to be plated, in a horizontal, face-down orientation, i.e., with the plated face 52 of the wafer 50 facing downwards towards the tray 12. The chuck 46 is moved in the horizontal direction perpendicular to the long direction of the tray 12 and transducer 22, i.e., across the ridge or wall 44. This draws the wafer 50 through the plating fluid above the rod 24. A plating current supply (not shown) has its positive side connected to the rod 24 and its negative side connected to the face 52 of the wafer. The plating supply may have a nominal plating voltage, e.g., 12 volts.

The horizontal positioning of the chuck and wafer, and the motion of the chuck relative to the tray, causes a relative horizontal motion so that the ridge or wall 44 sweeps across the face 52 of the wafer 50. When this happens, the electroplating fluid contacts the wafer 50 only along a horizontal line of contact, and the electrolyte does not flow to other areas of the wafer face 52. The electroplating is carried out non-turbulently and only along a well defined zone of contact, resulting in extreme evenness and a high level of repeatability from one wafer to the next.

The electroplating operation can require one pass or more than one pass, as required by the materials and chemistry involved.

Figure 4:
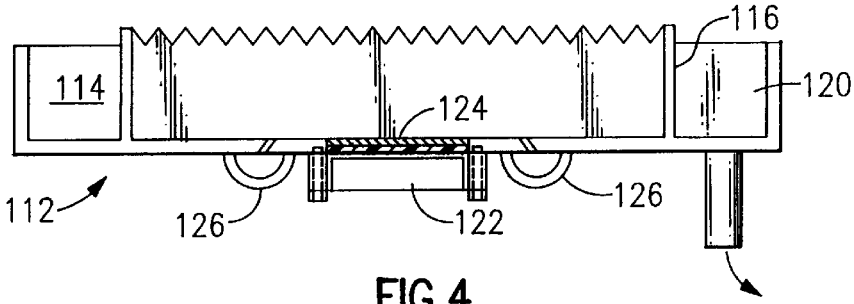
FIG. 4 is a sectional end view of a second embodiment.
Figure 4A:
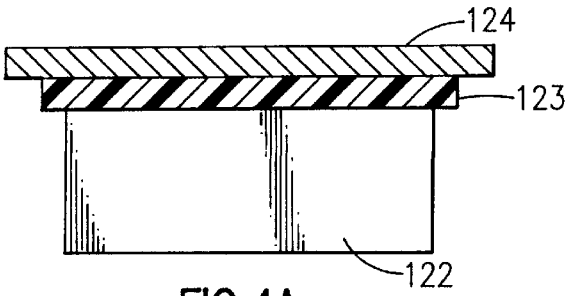
FIG. 4A is an enlargement of a portion of FIG. 4.

Another embodiment of this invention is illustrated in FIGS. 4 and 4A, in which elements that correspond to the same elements in FIGS. 1 and 2 are identified with the same reference numbers, but raised by 100. In this case, the tray 112 and spargers 126 are identical with those in the previous embodiment, with the weir 116 and the trough 120 serving the same purpose as previously. However, in place of the transverse rod 24, in this embodiment the anode is formed of a conductive surface 124 formed on the top surface of the megasonic transducer 122. As shown in FIG. 4A, on the top of the transducer 122 there is a dielectric or insulating layer 123, with a stainless-steel or similar non-reactive conductive layer 124 affixed on top of the dielectric layer 123.

While the invention has been described with reference to a preferred embodiment, it should be recognized that the invention is not limited to that precise embodiment, or to the variations herein described. Rather, many modifications and variations would present themselves to persons skilled in the art without departing from the scope and spirit of the invention, as defined in the appended claims.

What is claimed is:

1. A method of electroplating a face of a flat substrate with an electroplating bath that includes an elongated horizontally extending tray having an open top, an elongated horizontally extending megasonic transducer at a base of said tray, an anode extending horizontally above said transducer; and sparger means supplying an electrolyte into said tray so that the megasonic transducer creates a transverse ridge of said electrolyte in said tray that can contact a substrate passing above the open top of said tray; the method comprising applying megasonic energy to said transducer to create said transverse ridge of said electrolyte;

orienting said substrate horizontally and face down so that said transverse ridge contacts the face of said substrate;

effecting relative motion as between said substrate and said tray so that said ridge sweeps across the face of said substrate in a direction substantially across said transverse ridge; and applying plating current between said anode and said substrate.

2. The method of claim 1 wherein said anode includes a transverse conductive rod extending parallel to and above said transducer within said electrolyte.

3. The method of claim 1 wherein said anode is in the form of a conductive surface affixed onto a top of said transducer.

4. The method of claim 1 wherein said effecting of relative motion involves sweeping the ridge of said electrolyte across the face of said substrate one time only.

5. The method of claim 1 wherein said effecting of relative motion involves sweeping the ridge of said electrolyte across the face of said substrate a plurality of times.

6. The method of claim 1 wherein said flat substrate is a semiconductor wafer.

* * * * *